US006473065B1

(12) United States Patent
Fan

(10) Patent No.: US 6,473,065 B1
(45) **Date of Patent: *Oct. 29, 2002**

(54) METHODS OF IMPROVING DISPLAY UNIFORMITY OF ORGANIC LIGHT EMITTING DISPLAYS BY CALIBRATING INDIVIDUAL PIXEL

(76) Inventor: Nongqiang Fan, 9301 Avondale Rd. NE. #F2033, Redmond, WA (US) 98052

( * ) Notice: Subject to any disclaimer, the term of this patent is extended or adjusted under 35 U.S.C. 154(b) by 0 days.

This patent is subject to a terminal disclaimer.

(21) Appl. No.: 09/439,423

(22) Filed: Nov. 14, 1999

Related U.S. Application Data

(60) Provisional application No. 60/108,682, filed on Nov. 16, 1998.

(51) Int. Cl.[7] ..... G09G 3/32

(52) U.S. Cl. ..... 345/82; 345/83; 345/60; 345/74; 345/75; 345/76; 345/77; 345/78; 345/147; 345/204; 345/205; 345/206; 315/169.1; 315/169.2; 315/169.3

(58) Field of Search ..... 345/82, 83, 205, 345/206, 75, 204, 60, 74, 76, 77; 315/169.1, 169.2, 169.3

(56) References Cited

U.S. PATENT DOCUMENTS 5,262,698 A 11/1993 Dunham ..... 315/169.1
5,708,451 A 1/1998 Baldi ..... 345/75
5,903,246 A * 5/1999 Dingwall ..... 345/82
6,097,356 A 8/2000 Fan ..... 345/60
6,229,508 B1 * 5/2001 Kane ..... 345/82

* cited by examiner

*Primary Examiner*—Richard Hjerpe
*Assistant Examiner*—Ali Zamani

(57) ABSTRACT

Methods of improving the display uniformity of an OLED are disclosed. In order to improve the display uniformity of an OLED, the display characteristics of all organic-light-emitting-elements are measured, and calibration parameters for each organic-light-emitting-element are obtained from the measured display characteristics of the corresponding organic-light-emitting-element. The calibration parameters of each organic-light-emitting-element are stored in a calibration memory. One method for creating the compensated video data-signal is by storing into the video memory the compensated video word that is calculated based on the calibration parameters in the calibration memory and by fetching from the video memory the compensated video word. An alternative method for creating the compensated video data-signal is by fetching from the video memory the uncompensated video word and by using the calibration parameters in the calibration memory to calculate the compensated video data-signal.

22 Claims, 12 Drawing Sheets

(Priori Art)

METHODS OF IMPROVING DISPLAY UNIFORMITY OF ORGANIC LIGHT EMITTING DISPLAYS BY CALIBRATING INDIVIDUAL PIXEL

This invention is related to Organic Light Emitting Displays, and specially to a method for improving the display uniformity of Organic Light Emitting Displays.

This Application claims the benefit of U.S. Provisional No. 60/108,682, filed Nov. 16, 1998.

BACKGROUND OF THE INVENTION

An Organic Light Emitting Display (OLED) is a type of flat panel display based on a matrix of organic light emitting pixel elements. OLEDs have the potential to provide image qualities comparable to conventional CRT displays, and yet, they are light weight and can be built on flexible substrate. But, because the light intensity of each pixel is determined by the properties of the organic-light-emitting-element for that pixel, it is difficult to make OLEDs with uniform display intensity. The variations of the display intensity is due to the variations of the display characteristics of all organic-light-emitting-elements. The variations of the display characteristics are inevitable, because large numbers of organic-light-emitting-elements have to be manufactured over a very large area. It is important to improve the display uniformity, if one want to make OLEDs with large number of gray levels, such as 256 levels for each color.

In this document, the applicant present a new method, which the applicant claims to solve the uniformity problem of OLEDs once for all. The new method provides almost perfectly uniform display properties for OLEDs regardless the inevitable variations of each organic-light-emitting-element. The new method disclosed in this document is performed in three steps: First, the display characteristics of every organic-light-emitting-element in the display is measured. Second, the correct driving parameters for each organic-light-emitting-element—used as calibration parameters directly—are calculated and stored in a calibration memory as a complete look-up table, or the calibration parameters for each organic-light-emitting-element are calculated and stored in a calibration memory as a partial look-up table. Third, using the complete look-up tables or using partial look-up tables in combination with additional calculation, the correct driving parameter for any organic-light-emitting-element with any luminosity level can be obtained, and the correct driving parameters are used to drive the OLED. For the first step described above, the display characteristics of all organic-light-emitting-elements can be measured in a dark chamber by turning on one organic-light-emitting-element at a time. For the second step described above, linear approximation or other higher order approximation can be used. For the third step, there are two general embodiments: (1) with embodiment one, all the calculated correct driving parameters are stored in a video memory and the driver electronics use these calculated correct driving parameters in the video memory to drive the display; (2) with embodiment two, the desired light intensities are stored in a video memory without any compensation, and using the complete look-up tables or using partial look-up tables in combination with additional calculation, the driver electronics calculate the correct driving parameters by fetching the light intensities from the video memory and use these calculated correct driving parameters to drive the display directly. For both embodiments mentioned above, when partial look-up tables are used, additional calculations are needed to obtain the correct driving parameters, and these calculations can be performed by the main microprocessor or a dedicated display processor.

SUMMARY OF THE INVENTION

It is an object of the invention to provide a method that can provide almost perfectly uniform display properties for OLEDs regardless the inevitable variations of each organic-light-emitting-element.

Additional advantages and novel features of the invention will be set forth in the description which follows, and in part will become apparent to those skilled in the art upon examination of the following, or may be learned by practice of the invention. The objects and advantages of the invention maybe realized and attained by means of the instrumentality and combinations particularly pointed out in the appended claims.

To achieve the foregoing and other objects and in accordance with the present invention, as described and broadly claimed herein, a measurement method is provided to measure the display characteristics of every organic-light-emitting-element in the display, a calculation method is provided to obtain the calibration parameters of any given organic-light-emitting-element by using the measured display characteristics of the corresponding organic-light-emitting-element as the raw data, a calibration memory is provided to store the calibration parameters for any given organic-light-emitting-element as a complete look-up table or as a partial look-up table, a method is provided to obtain the correct driving parameters for any given organic-light-emitting-element for any give light intensity by using the complete look-up table without additional calculation or by using the partial look-up table with additional calculation, and finally a driver electronics is provided to drive the display with the correct driving parameters. For the measurement method provided to measure the display characteristics of every organic-light-emitting-element in the display, a dark chamber can be used. An OLED driven by the correct driving parameters will provide images free of intensity distortions caused by each organic-light-emitting-element's property variations.

BRIEF DESCRIPTION OF THE DRAWINGS

The accompany drawings, which are incorporated in and form a part of the invention and, together with the description, serve to explain the principles of the invention. In the drawings, closely related figures have the same number but different alphabetic suffixes.

DESCRIPTION OF THE INVENTION

Figure 1:
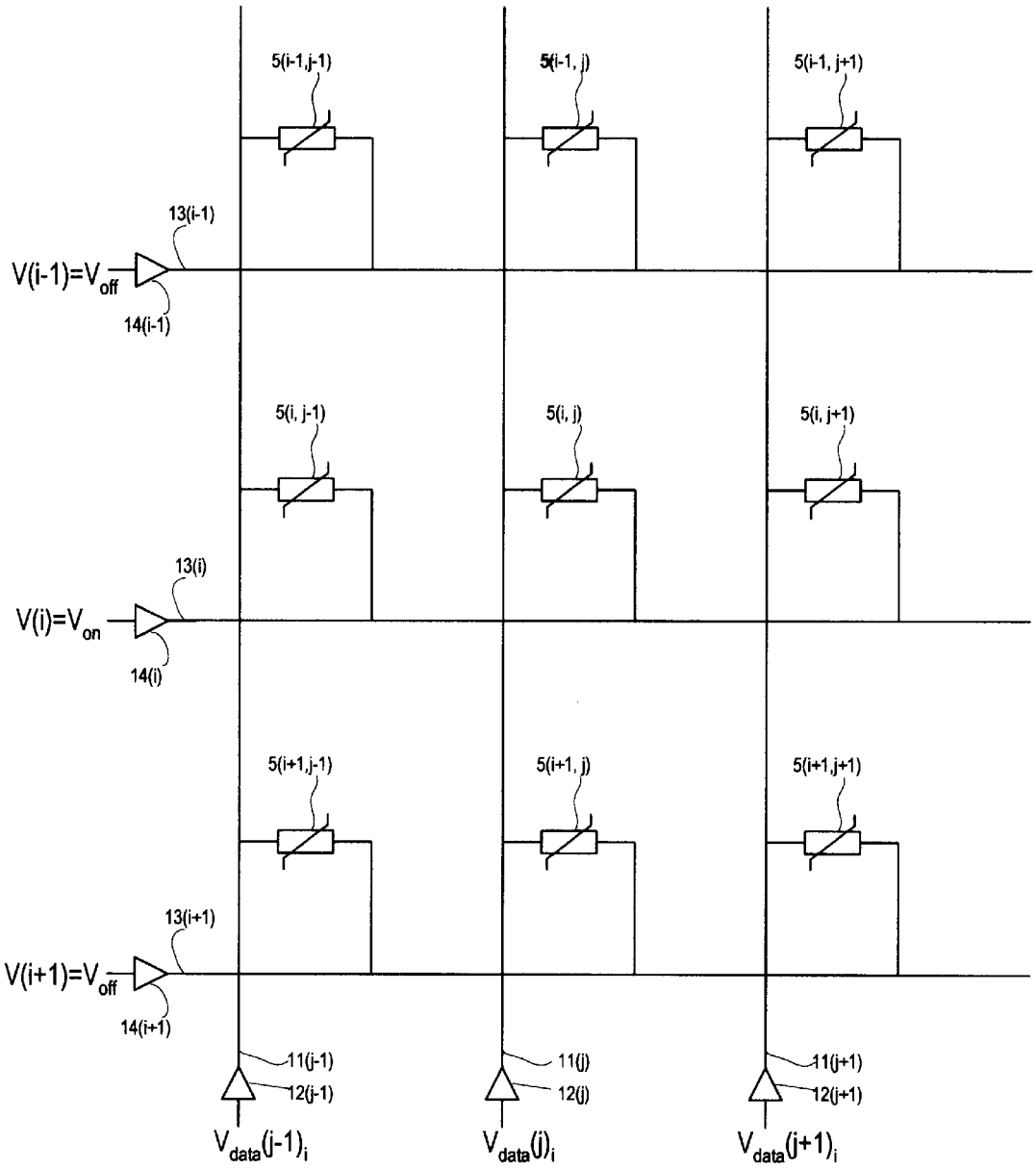
FIG. 1 shows an OLED display with a matrix of organic-light-emitting-elements.

FIG. 1 shows one of the priori art embodiment of an OLED based on organic-light-emitting-elements. In FIG. 1, the OLED consists of an array of column driving lines 11(*j*) and an array of row driving lines 13(*i*), and these two arrays of driving lines form a matrix structure. The cross position between each column driving line and each row driving line defines a pixel by connecting an organic-light-emitting-element 5(*i,j*) at that cross position. Each column driving line 11(*j*) is connected to a voltage driver 12(*j*), and each row driving line 13(*i*) is connected to a voltage driver 14(*i*). If the driver voltage for the i'th row is $V_i$ and the driver voltage for the j'th column is $V_j$, then, the voltage applied to organic-light-emitting-element 5(*i,j*) is $V_j-V_i$.

FIG. 1 also shows how to drive the above described OLED. As shown in FIG. 1, at any instance, the driving line of only one row (for example, row i) are set to the on-voltages$-V_{on}$ and the driving lines for all remaining rows are set to off-voltages $V_{off}$. Because only one row has the corresponding driving lines in on-voltages$-V_{on}$, only pixel elements in that selected row are in the light-emitting mode to emit light, while pixel elements in all the other rows are in the light-off mode. When a pixel element (i,j) in the selected row i is in light-emitting mode, the data-voltage $V_{data}(j)_i$ on driving line for the j'th column will determine the total voltage applied to organic-light-emitting-element (i,j), $V(i,j)=V_{data}(j)_i+V_{on}$; therefor, the data-voltage $V_{data}(j)_i$ will determine the light intensity of pixel (i,j). After all pixels in row i is in light-emitting mode for a predetermined time period, row i will be set to light-off mode and row i+1 will be set to light-emitting mode. After row i+1, row i+2 is in light-emitting mode, then row i+3, . . . and so on. All the rows are in light-emitting mode progressively one by one.

Figure 2A:
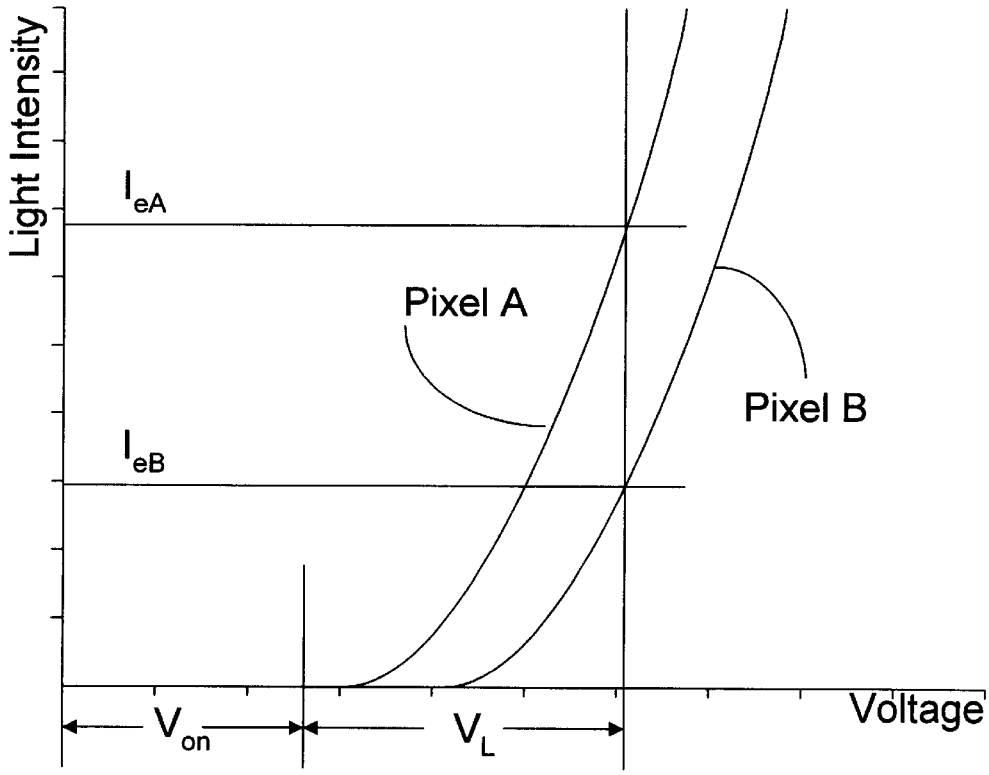
FIG. 2*a* shows that, with the same bias voltage, two different organic-light-emitting-elements give completely different light intensity.
Figure 2B:
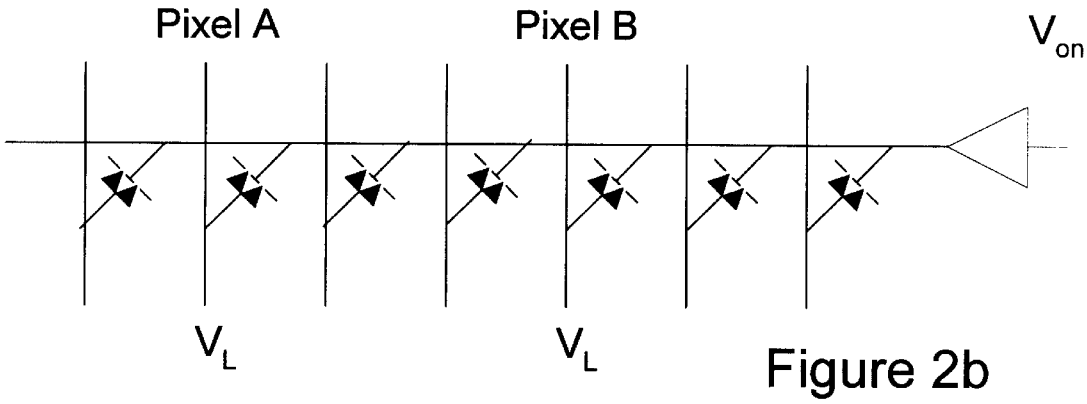
FIG. 2*b* shows that the same bias voltage is applied to two different organic-light-emitting-elements in the same selected row.

The display uniformity problem is due to the variations of display characteristics of all the organic-light-emitting-elements in the matrix. Such variations are inevitable, because very large number of organic-light-emitting-elements are manufactured. FIG. 2*a* shows that, with the same bias voltage, two different organic-light-emitting-elements give completely different light intensity, where, $-V_{on}$ is the voltage applied by the on-state driver to select a particular row into emission mode, and $V_L$ is the same luminosity voltage applied to organic-light-emitting-element A and organic-light-emitting-element B as indicated in FIG. 2*b*. As shown in FIG. 2*a*, even though the total voltage applied to the two organic-light-emitting-elements(A and B) is the same $V_{on}+V_L$, the light intensity from the two organic-light-emitting-elements are different (they are $I_{eA}$ and $I_{eB}$ respectively for organic-light-emitting-element A and B), because the display characteristics (or the curve defined by light intensity $I_e$ versus driving-voltage V) of the two organic-light-emitting-elements are different. These difference in light intensity can be compensated, however, if one knows the display characteristics of the corresponding organic-light-emitting-elements.

The very basic idea of present invention can be summarized by operating an OLED in three steps. First, the display characteristics of every organic-light-emitting-element in the display is measured. Second, the correct driving voltages for each organic-light-emitting-element used as calibration parameters directly are calculated and stored in a calibration memory as a complete look-up table—which is called method one, or the calibration parameters for each organic-light-emitting-element are determined and stored in a calibration memory as a partial look-up table—which is called method two. Third, when a certain light intensity in a certain pixel is to be displayed, the microprocessor will use the a complete look-up table in the calibration memory to find the correct driving voltage for that light intensity, or, the microprocessor will use the partial look-up table in the calibration memory in combination with additional calculation to find the correct driving voltage for that light intensity, and the correct driving voltage is used by the driver electronics to drive the display.

Figure 3:
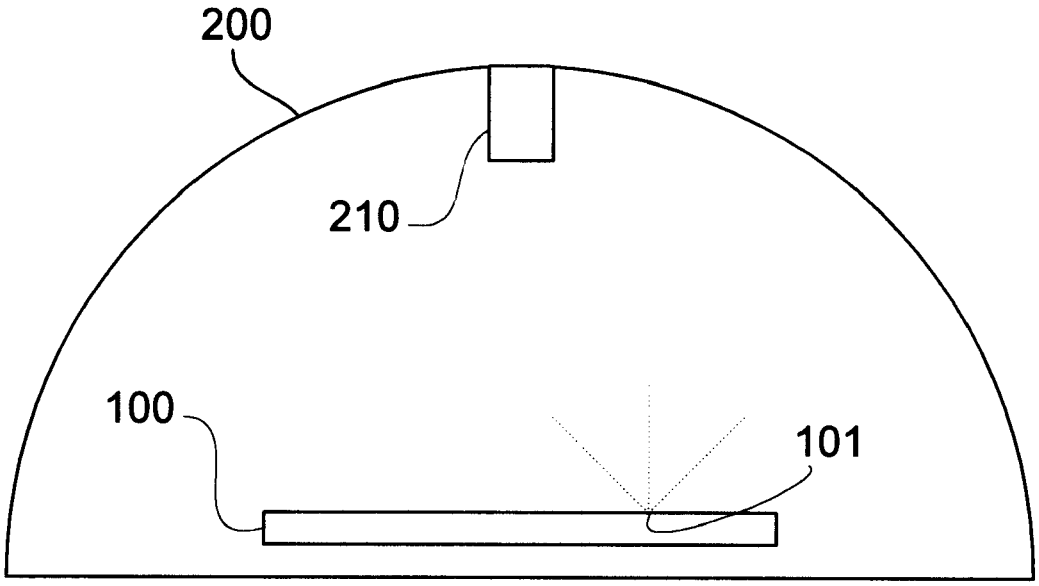
FIG. 3 shows that display characteristics of every organic-light-emitting-element is measured by a photo detector in a dark chamber by turning on only one organic-light-emitting-element at a time.

FIG. 3 shows how the display characteristics of all organic-light-emitting-elements can be measured. As shown in FIG. 3, for a particular OLED 100, to obtain a table of light-intensity versus driving-parameter for a pixel 101, be it complete or partial, one can put OLED 100 in a dark chamber 200 and use a photo detector 210 to measure the light intensities with a set of driving parameters for that pixel 101 while all the rest of pixels are completely turned off. By measuring the light intensity of that pixel corresponding to several different values of luminosity voltage, the display characteristics of that one organic-light-emitting-element is measured and stored in a memory for further processing. The number of points on the display characteristics need to be measured depend on the non-linearity of the emission curve and the required display resolution (e.g. 4 bit or 8 bit). And, one need to repeat the same procedure one pixel at a time, until the tables of light-intensity versus driving-parameter for all pixels in the OLED are measured. These steps of measuring display characteristics of each pixel in a OLED can be performed in the factory before the OLED is shipped. The measurement may need to be performed with different temperatures in the case that the display characteristics of each pixel is temperature dependent. Then, these measured display characteristics are used to obtain the complete or partial look-up tables. Finally, the complete or partial look-up tables are stored in a permanent memory for future use.

Figure 4A:
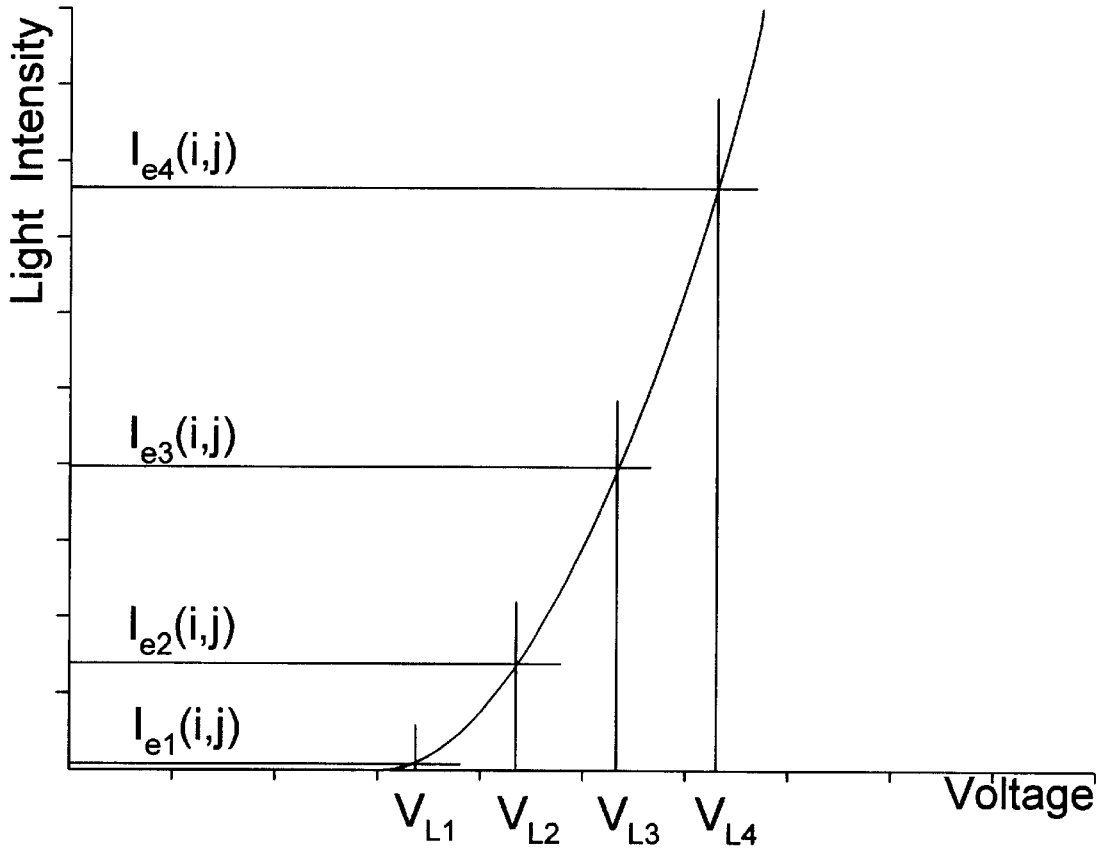
FIG. 4*a* shows that the display characteristics of an organic-light-emitting-element is measured by measuring the light intensity of the organic-light-emitting-element under several selected bias voltages.

As shown in FIG. 4*a*, the display characteristics of a organic-light-emitting-element at row i and column j, is characterized by a set of numbers, $I_{e1}(i,j)$ for luminosity voltage $V_{L1}$, $I_{e2}(i,j)$ for luminosity voltage $V_{L2}$, $I_{e3}(i,j)$ for luminosity voltage $V_{L3}$, . . . and $I_{eH}(i,j)$ for luminosity voltage $V_{LH}$, where H is the number of points on the emission curve measured for each organic-light-emitting-element. These numbers are stored in a memory for further processing. If the number of row is N and the number of column is M, then a total of N*M*H numbers are stored in the memory.

If an organic-light-emitting-element has no degrading effect, the above calibration process need to be performed only once. If there are organic-light-emitting-element degrading effect, above calibration process need to be performed again at a later time to correct the organic-light-emitting-element degrading effect.

Figure 4B:
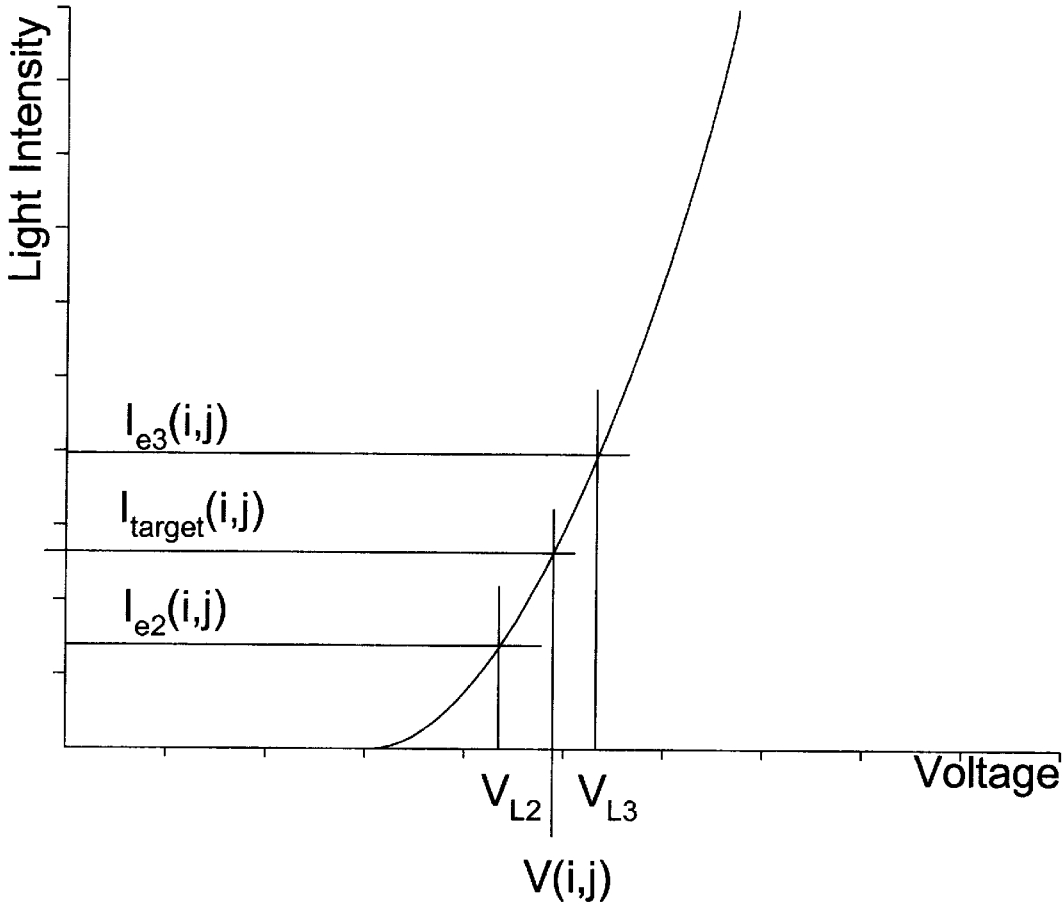
FIG. 4*b* shows that one can use linear approximation and measured data points to calculate the correct voltage V(i,j) that will provide the desired light intensity $I_{target}(i,j)$.

After the measurement of the emission curves of all organic-light-emitting-elements, the correct driving voltage for any desired light intensity for any organic-light-emitting-element can be calculated. For example, for organic-light-emitting-element (i,j) at i'th row and j'th column, to calculate the correct driving voltage for a desired light intensity $I_{target}(i,j)$, one first compare the desired light intensity $I_{target}(i,j)$ with all the measured light intensity $I_{e1}(i,j)$, $I_{e2}(i,j)$, $I_{e3}(i,j)$ and $I_{eH}(i,j)$. Suppose that $I_{target}(i,j)$ happen to be between $I_{e2}(i,j)$ and $I_{e3}(i,j)$, as shown in FIG. 4*b*, then, one can simply use linear approximation to calculate the correct driving voltage V(i,j), which is given by $$V(i,j)=\frac{V_{L3}[I_{target}(i,j)-I_{e2}(i,j)]+V_{L2}[I_{e3}(i,j)-I_{target}(i,j)]}{I_{e3}(i,j)-I_{e2}(i,j)}$$

Or, to increase the accuracy in calculating V(i,j), one can use parabola approximation or other higher order approximations. For polynomial approximation with order H, the correct driving voltage V(i,j) is given by $$V(i,j)=\frac{[I_{e2}(i,j)-I_{target}(i,j)][I_{e3}(i,j)-I_{targe}(i,j)]\cdots[I_{eH}(i,j)-I_{target}(i,j)]}{[I_{e2}(i,j)-I_{e1}(i,j)][I_{e3}(i,j)-I_{e1}(i,j)]\cdots[I_{eH}(i,j)-I_{e1}(i,j)]}V_{L1}(i,j)+$$
$$\frac{[I_{e1}(i,j)-I_{target}(i,j)][I_{e3}(i,j)-I_{target}(i,j)]\cdots[I_{eH}(i,j)-I_{target}(i,j)]}{[I_{e1}(i,j)-I_{e2}(i,j)][I_{e3}(i,j)-I_{e2}(i,j)]\cdots[I_{eH}(i,j)-I_{e2}(i,j)]}V_{L2}(i,j)+\cdots$$

One can even use more complicated algorithm, such as, use least square fit in combination with device models to calculate the correct driving voltage V(i,j) which can achieve the desired intensity $I_{target}(i,j)$.

There are generally two methods of using the measured emission curve to provide a perfectly uniform display. With method one, for every organic-light-emitting-element in the display, the correct driving voltages for all gray levels are calculated; these correct driving voltages are used as calibration parameters directly and stored as complete look-up tables in a calibration memory for future use; and one will use the complete look-up table to find the correct driving voltages without the need to perform additional calculation. With method two, for every organic-light-emitting-element in the display, calibration parameters are calculated and stored as partial look-up tables in a calibration memory for future use; and one will use the partial look-up table in combination with some additional calculation in real time to find the correct driving voltages. As for the calibration parameters, the correct driving voltages for selected number of gray levels can be calculated and used as the calibration parameters, or other model-dependent parameters can be calculated and used as the calibration parameters.

If there is no organic-light-emitting-element degrading effect, the above described look-up tables need to be calculated only once, and these look-up tables can be stored in a permanent memory, such as ROM, or hard disk. If there are organic-light-emitting-element degrading effect, the above described look-up tables need to calculated again at a later time to correct the organic-light-emitting-element degrading effect. If the look-up tables are stored in a relatively fast ROM, the ROM can be used directly as the calibration memory. If the look-up tables are stored in a slower permanent memory, say, hard disk, the look-up tables will have to be loaded into a faster RAM from the permanent memory, and use this RAM as the calibration memory.

Figure 5A:
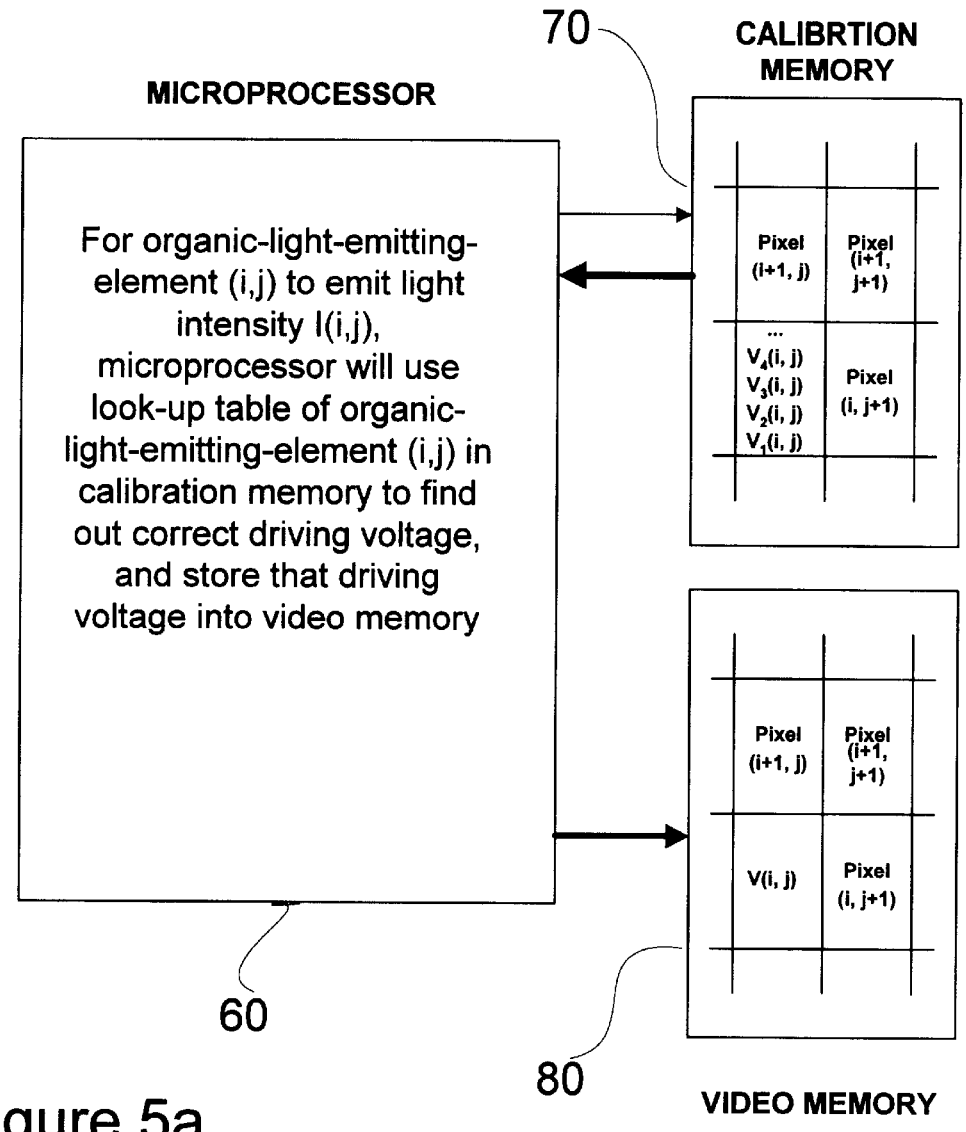
FIG. 5*a* shows that a microprocessor use the look-up table in the calibration memory to find out the correct driving voltage, and store the correct driving voltage into the video memory.
Figure 5B:
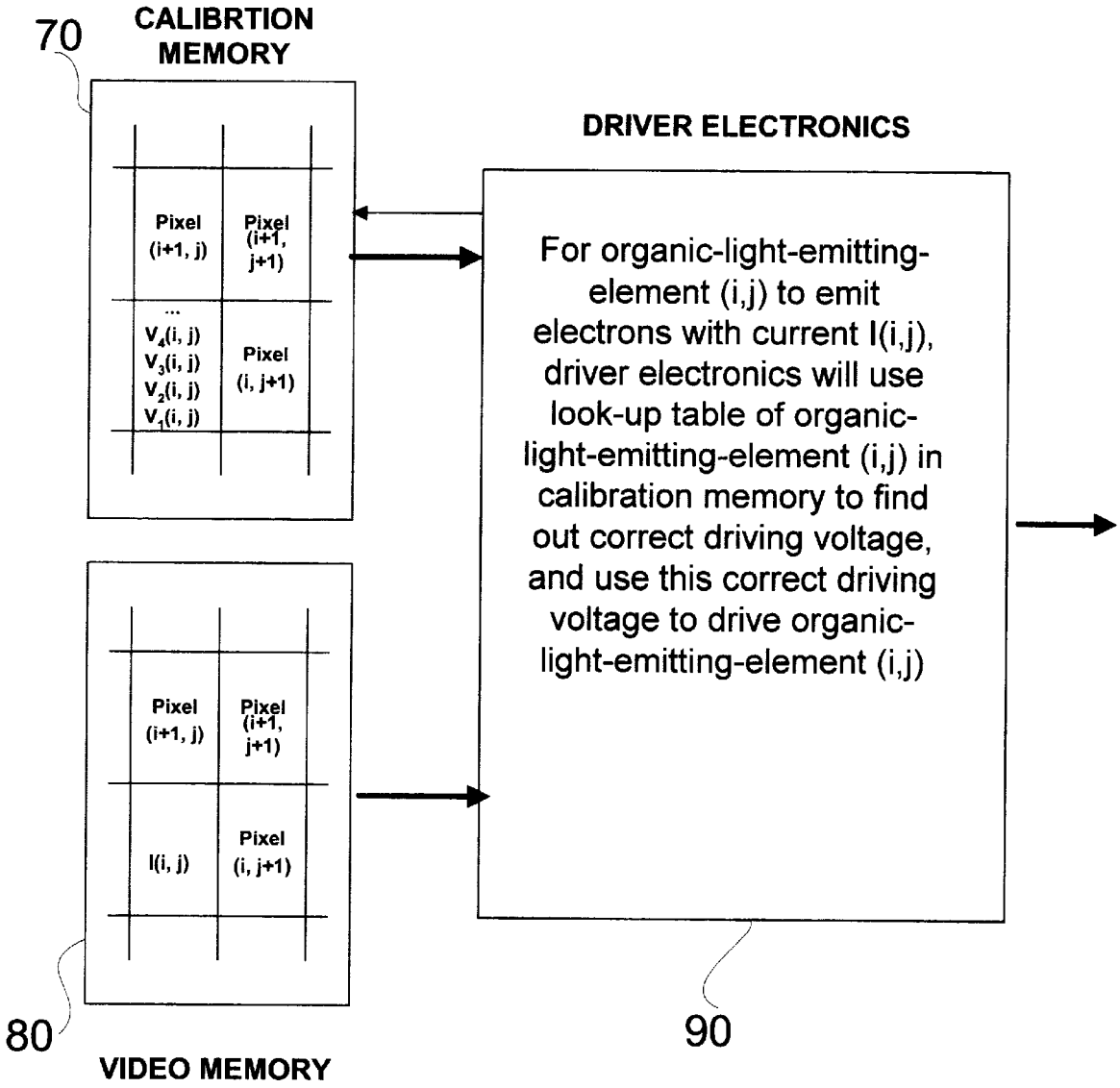
FIG. 5*b* shows that the driver electronics fetch uncompensated light intensity from the video memory and use the look-up table in calibration memory to find out the correct driving voltage.

FIG. 5*a* shows in detail the method one mentioned above. With method one, for every organic-light-emitting-element in the display, the correct driving voltages—$V_1(i,j)$, $V_2(i,j)$, $V_3(i,j)$, . . . , and $V_K(i,j)$—for all gray levels with corresponding desired light intensity—$I_1$, $I_2$, $I_3$ . . . , and $I_K$— are calculated by using linear approximation or other previously described methods. More specifically, for 8 gray levels, 8 voltages are calculated for each organic-light-emitting-element, and for 256 gray levels, 256 voltages are calculated. These calculated correct driving voltages are used as calibration parameters directly and stored in a calibration memory 70. With a conventional display, if a computer want a pixel to display certain intensity, it will write the intensity word (which is a byte for 8 bit gray level) of the pixel to a location in the video memory 80, and the driver electronics will use the intensity words in video memory 80 to drive the display. With present newly invented display, however, if a computer want a pixel to display certain desired intensity, it will first use the look-up table of the organic-light-emitting-element associated with the corresponding pixel in calibration memory 70 to find out the correct driving voltage for that desired intensity, write this correct driving voltage to video memory 80, and the driver electronics will use the correct driving voltages in video memory 80 to drive the OLED. Alternatively, as shown in FIG. 5*b*, the computer can still write the uncompensated intensity word to video memory 80, but, the driver electronics itself will use the look-up tables in calibration memory 70 to find out the correct driving voltage for any gray level of any organic-light-emitting-element, and use this correct driving voltage to drive the OLED.

Above described method one is relatively easy to implement, but, if a display has large number of organic-light-emitting-elements and each organic-light-emitting-element has large number of gray levels, the amount of calibration memory required can be quite large. For example, for a 256-gray-level display with one million pixels, one need to store 256 million numbers. If each correct driving voltage is stored as a byte to represent the absolute number, then, 256 Megabyte calibration memory is needed. To reduce the memory requirement, one can instead store relative numbers in calibration memory 70. For example, one can sore relative number $\Delta V_k(i,j)=V_k(i,j)-\overline{V}_k$ into calibration memory 70, where $\overline{V}_k=\Sigma V_k(i,j)$ is the average driving voltage for gray level k averaged over all organic-light-emitting-elements, and $1\leqq k\leqq K$. If the variations among different organic-light-emitting-elements are small, one can use a smaller number of bit (such as 4 bit) to represent $\Delta V_k(i,j)$ even one need 8 bit to represent $V_k(i,j)$. Another way to reduce the calibration memory requirement, which is the method two mentioned previously, is to use partial look-up tables, instead of complete look-up tables.

Figure 6A:
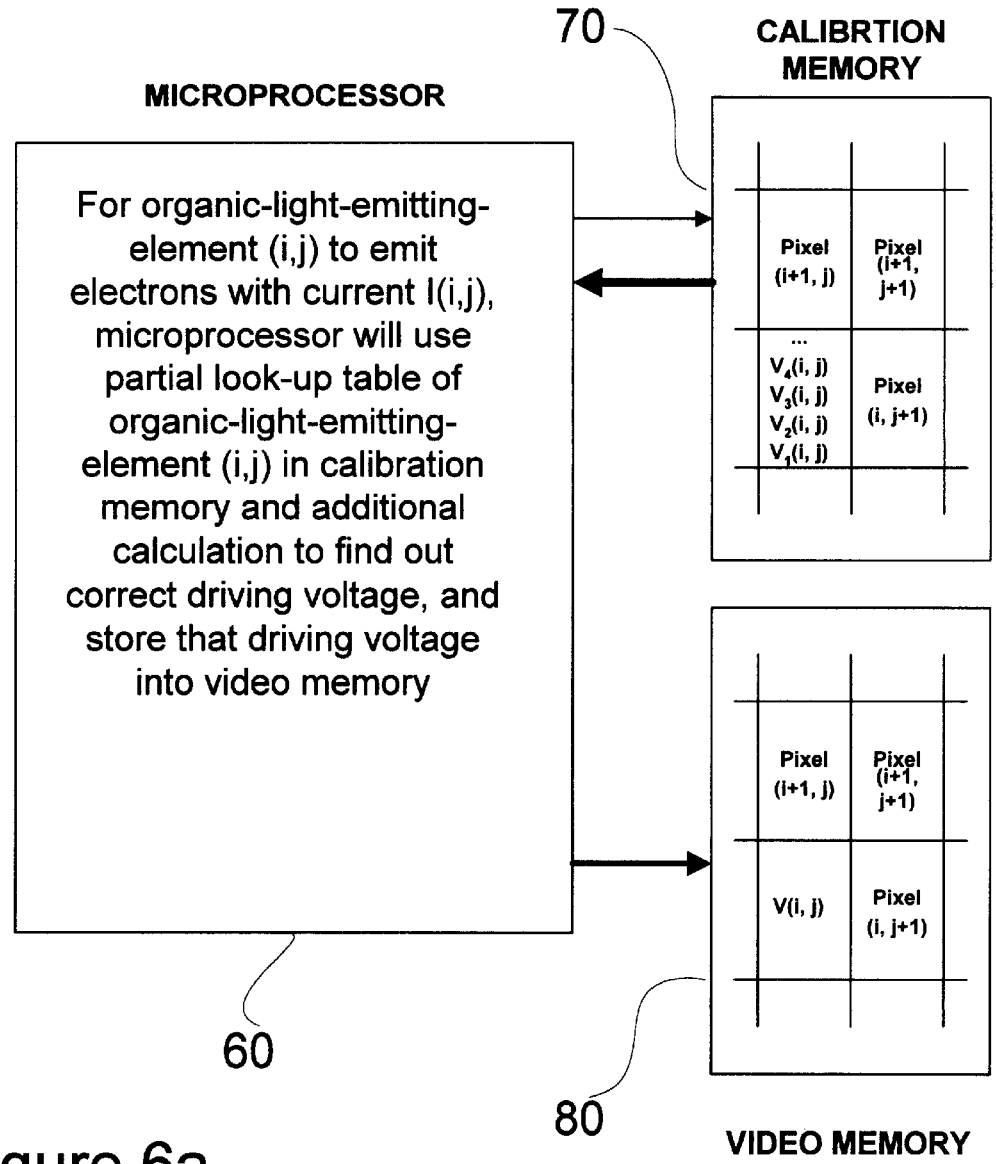
FIG. 6*a* shows that a microprocessor use the partial look-up table in the calibration memory in combination with additional calculation to find out the correct driving voltage, and store the correct driving voltage into the video memory.
Figure 6B:
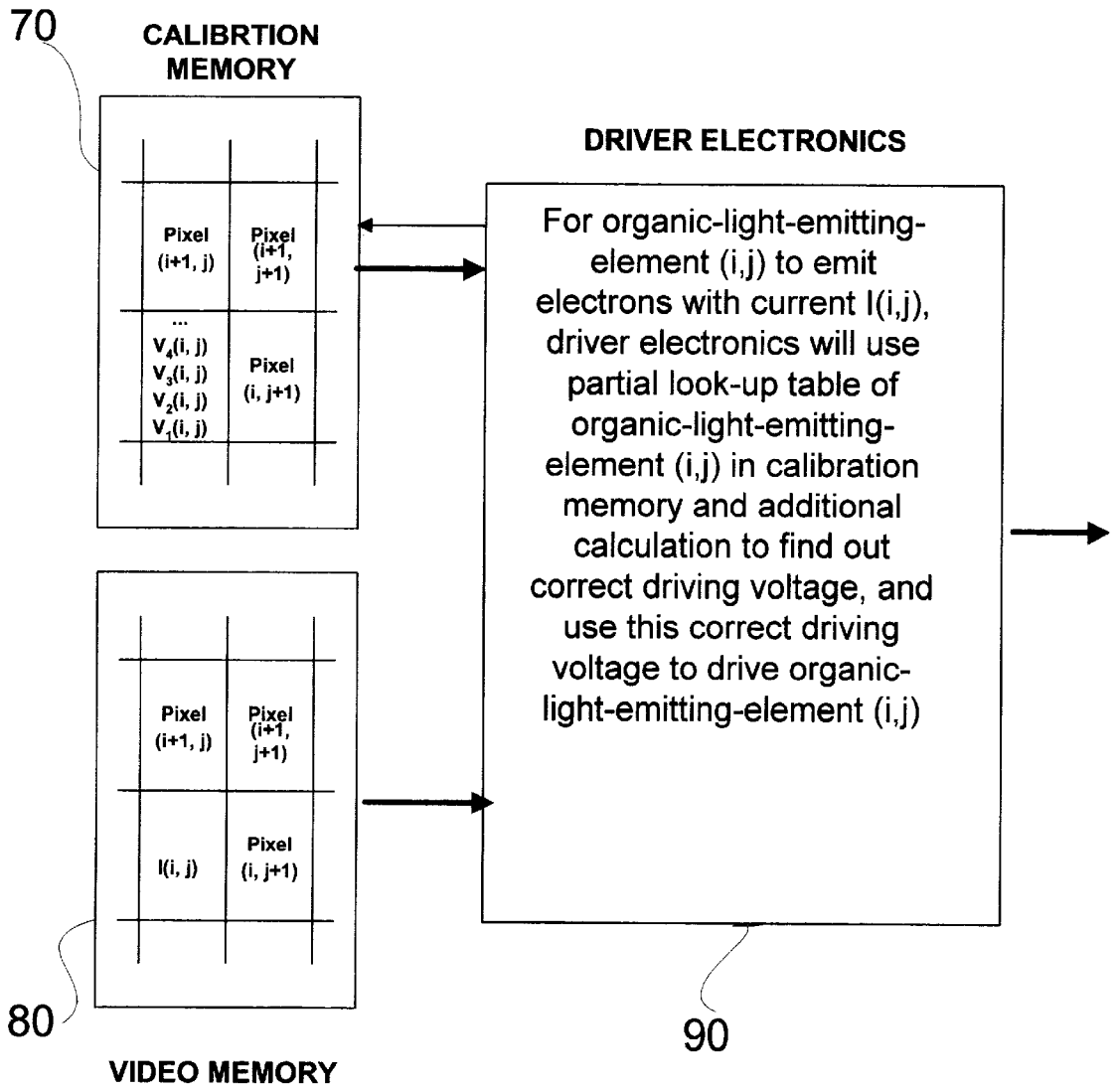
FIG. 6*b* shows that the driver electronics fetch uncompensated light intensity from the video memory and use the partial look-up table in the calibration memory in combination with additional calculation to find out the correct driving voltage.

FIGS. 6*a* and 6*b* show in detail the method two mentioned previously. With method two, for every organic-light-emitting-element in the display, the correct driving voltages—$V_1(i,j)$, $V_2(i,j)$, $V_3(i,j)$, . . . , and $V_K(i,j)$—for selected number of gray levels with corresponding desired light intensity—$I_1$, $I_2$, $I_3$ . . . , and $I_K$— are calculated and used as calibration parameters. These calibration parameters are stored as partial look-up tables in a calibration memory 70 for future use. The driver electronics will use the partial look-up tables in combination with some additional calculation in real time to find the correct driving voltages. Where the number of gray levels K selected are smaller than the number of total gray levels. As for the issue on how to chose $I_1$, $I_2$, $I_3$ . . . , and $I_K$, it may be chosen based on the non-linearity of the emission curve or just chosen for convenience, such as for a four point calibration, one simply may chose $I_1=(1/4)I_0$, $I_2=(2/4)I_0$, $I_3=(3/4)I_0$, and $I_4=I_0$, where $I_0$, is the light intensity corresponding to the maximum light intensity.

After the calibration parameters are calculated and stored as partial look-up tables in calibration memory 70, the next step is to use the partial look-up tables to calculate the correct driver voltages to provide nearly perfect display uniformity for an OLED.

With a conventional display, if a computer want a pixel to display certain intensity, it will write the intensity word (which is a byte for 8 bit gray level) of the pixel to a location in a video memory, and the driver electronics will use the intensity words in the video memory to drive the display. With present newly invented display, however, if a computer want a pixel to display certain desired intensity, it will first fetch the related calibration parameters from the corresponding partial look-up table from calibration memory 70, as shown in FIG. 6*a*, then, use these calibration parameters along with the intensity word to calculate the correct driving voltage that can achieve the desired intensity for that pixel, write this correct driving voltage to video memory 80, and the driver electronics will use the correct driving voltages in video memory 80 to drive the OLED. Alternatively, as shown in FIG. 6*b*, the computer can still write the uncompensated intensity word to video memory 80, but, the driver electronics itself will use the partial look-up table in calibration memory 70 in combination with some calculations to find out the correct driving voltage for any gray level of any organic-light-emitting-element, and use this correct driving voltage to drive the OLED directly. In both of the above two alternatives, some calculations are required to obtain the correct driving voltage; these calculation can be performed with a microprocessor 60, which can be the main microprocessor or preferably a dedicated display processor. In the following, several algorithms for performing these calculations are described, and for linear approximation, a specific design of display processor 60 is described.

Figure 7A:
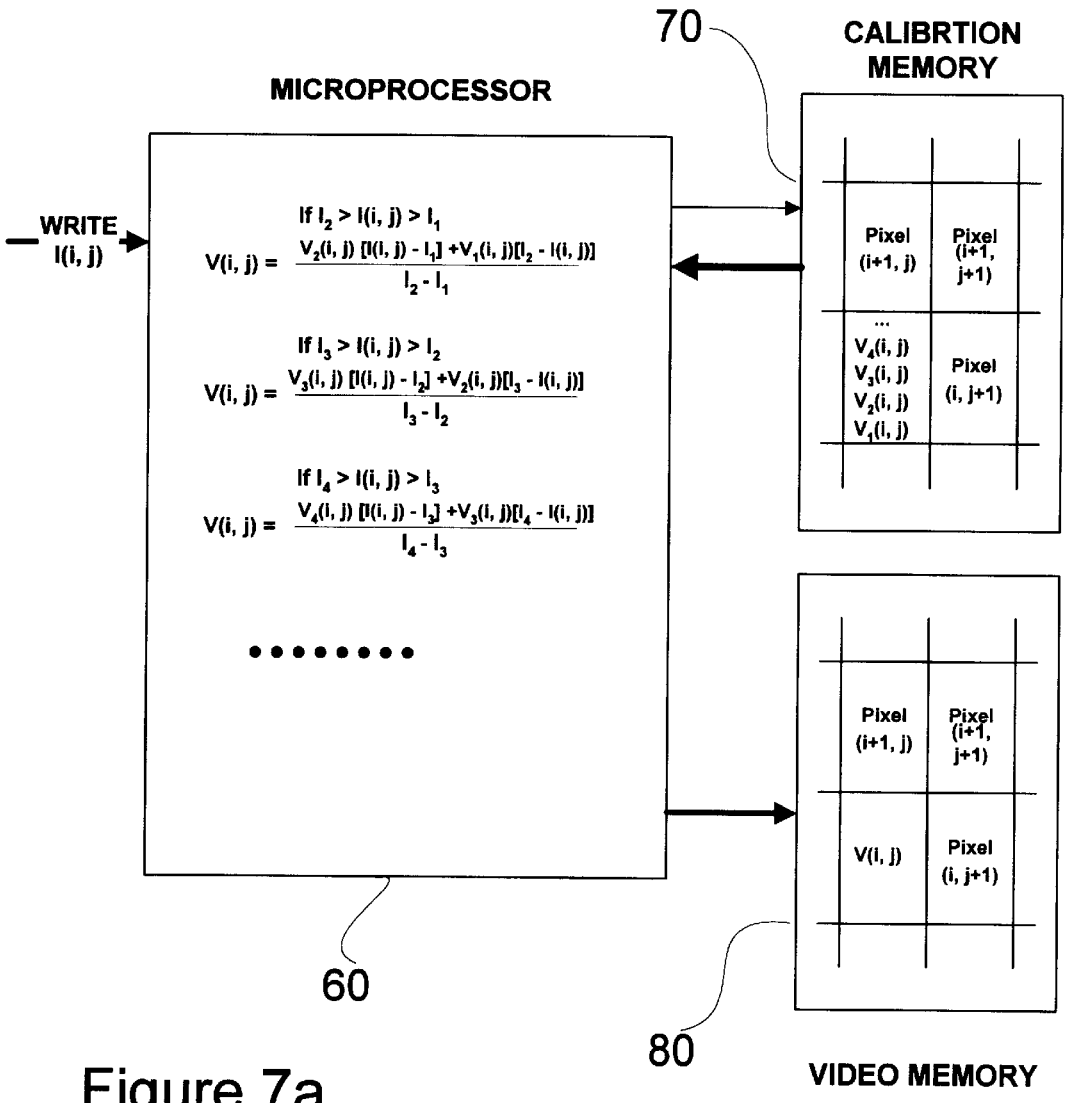
FIG. 7*a* shows that a microprocessor use the partial look-up table in the calibration memory in combination with linear approximation to calculate the correct driving voltage, and store the correct driving voltage into the video memory.
Figure 7B:
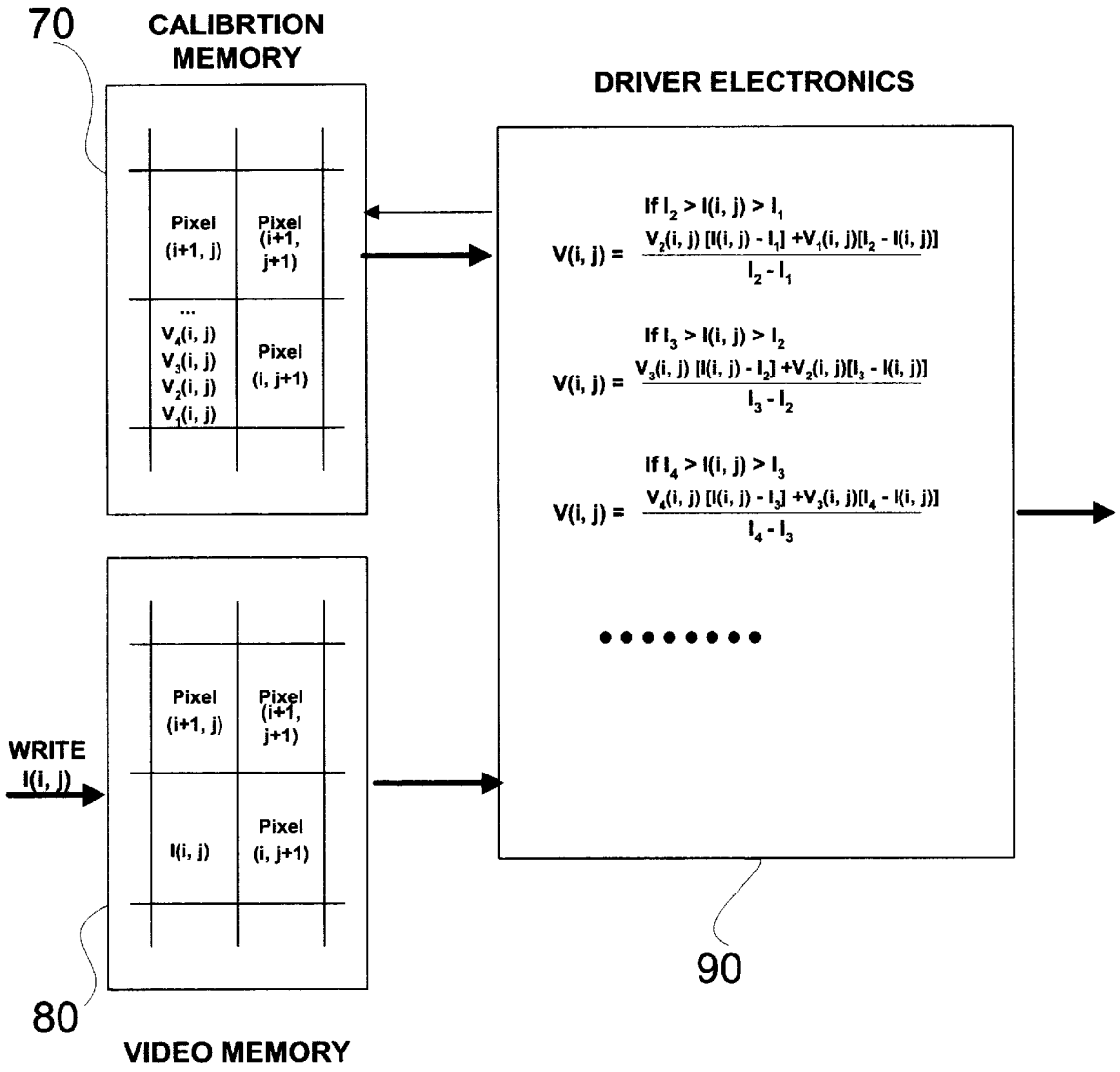
FIG. 7*b* shows that the driver electronics fetch uncompensated light intensity from the video memory and use the partial look-up table in the calibration memory in combination with linear approximation to calculate the correct driving voltage.

FIG. 7*a* illustrates a specific implementations of FIG. 6*a* based on linear approximations, and FIG. 7*b* illustrates that of FIG. 6*b*. In FIG. 7*a* or 7*b*, the microprocessor 60 or driver electronics 90 first compare desired intensity I(i,j)—which is the desired light intensity in this case—with the set of intensity levels ($I_1$, $I_2$, $I_3$ . . . , and $I_K$) which have pre-calculated driving voltages stored in calibration memory 70, the microprocessor find the two numbers (among $I_1$, $I_2$, $I_3$ . . . , and $I_K$) which are most close to the desired intensity I(i,j)); the microprocessor 60 or driver electronics 90 will then fetch the driving voltages corresponding to these two numbers from calibration memory 70 and use liner approximation to calculate the driving voltage V(i,j) which can achieve the desired intensity I(i,j); finally, the calculated driving voltage V(i,j) is stored in video memory or used by driver electronics to driver the display directly. Take an example of how V(i,j) is calculated, if $I_2<I(i,j)<I_3$, then $$V(i,j)=\frac{V_3(i,j)[I(i,j)-I_2]+V_2(i,j)[I_3-I(i,j)]}{I_3-I_2}.$$

Figure 7C:
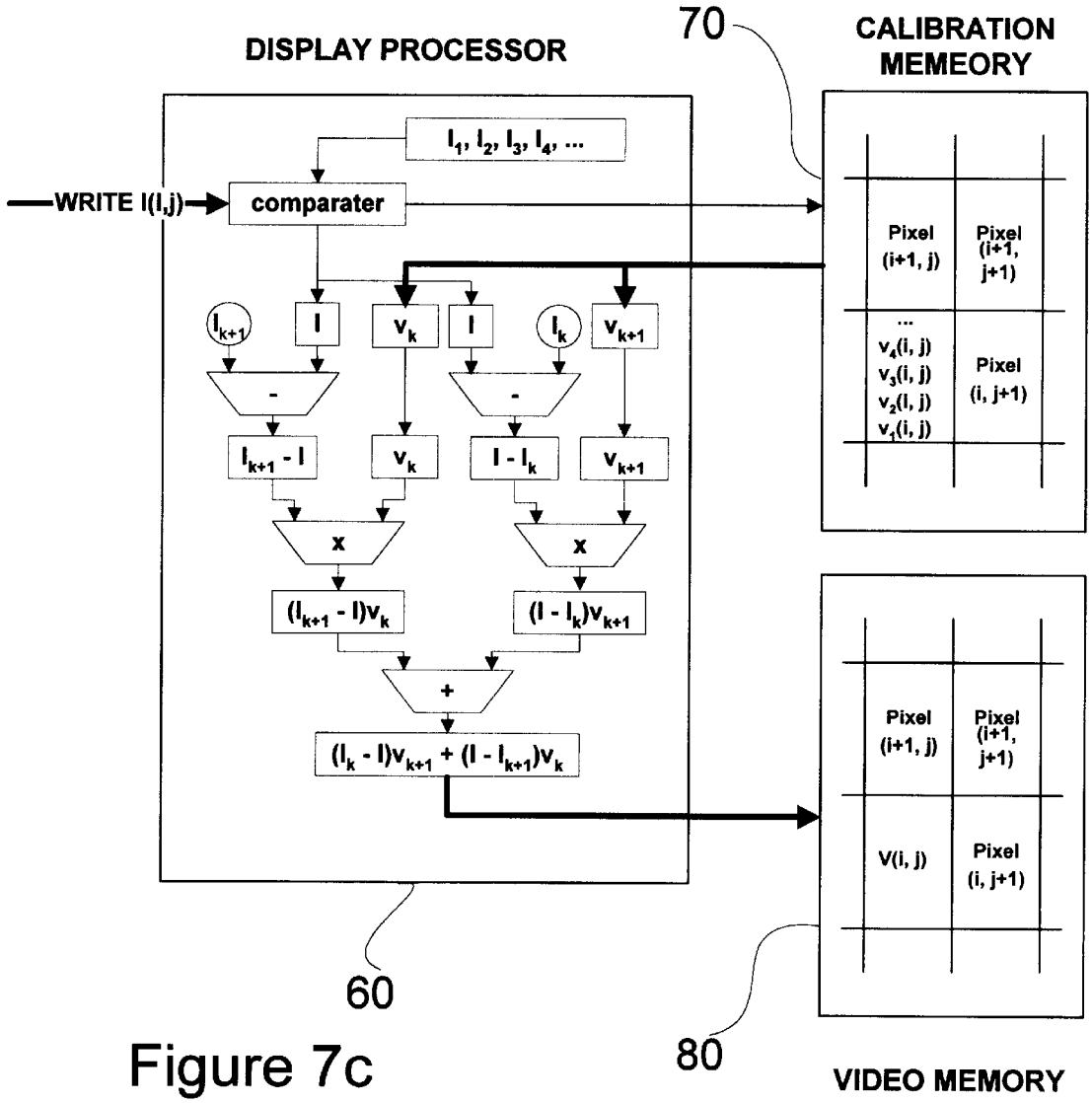
FIG. 7*c* shows a specific implementation of a display processor which uses linear approximation to calculate the correct driving voltage.

In fact to simplify the above calculation and speed up the calculation in real time, one can chose $\Delta I=I_2-I_1=I_3-I_2=\ldots=I_K-I_{K-1}$ and rather than store $V_k(i,j)$ (with k=1, 2, . . . K) in the calibration memory, one can store $v_k(i,j)=V_k(i,j)/\Delta I$ (with k=1, 2, . . . K) in calibration memory 70. The microprocessor 60 or driver electronics 90 then use $v_k(i,j)$ to calculate the desired voltage $V(i,j)=v_{k+1}(i,j)[I(i,j)-I_k]+v_{k+1}(i,j)[I_{k+1}-I(i,j)]$, where $I_k<I(i,j)<I_{k+1}$. The microprocessor used to perform the above calculations can be the main microprocessor or a dedicated display processor. FIG. 7*c* illustrates a specific design of display processor 60 based on above linear approximation by using hardware gate elements.

To minimize the calibration memory requirement one can store a normalized variation of $v_k(i,j)$. The normalized variation $\alpha_k(i,j)$ is defined by $v_k(i,j)=\bar{v}_k[1+S\alpha_k(i,j)]$, where S is a scaling factor which depend on the variations of all the $v_k(i,j)$, and $\bar{v}_k$ is the average of $v_k(i,j)$ over all organic-light-emitting-element $$\bar{v}_k=\frac{1}{N*M}\sum_{i=1,j=1}^{N,M} v_k(i,j).$$

The average $\bar{v}_1$, $\bar{v}_2$, $\bar{v}_3$ . . . , and $\bar{v}_K$, and the scaling factor S are also stored in a memory, and these numbers can be loaded into the microprocessor to perform the calculation. The design of a dedicated display processor by using the normalized variation $\alpha_k(i,j)$ is straight forward for the people skilled in the art, and will not be discussed further here.

To demonstrate the feasibility of the current invention, we now estimate the amount of the calibration memory that is required and the processing power of the display processor that is required. Assume the display have 1600×1200 pixels, and assume four calibration points are stored for each emission curve, if one byte is used to store each normalized variation $\alpha_k(i,j)$, then, the total memory required is 1600×1200×4=7,680,000 byte. If the display is refreshed 60 times in a second, then, 1600×1200×60=115,200,000 calculations need to be performed in a second. The sample architecture of the display processor in FIG. 7*c* indicates that simple pipe line design can be used, and with the pipeline design one calculation can be performed with every clock cycle. Therefore, a display processor running at 115 MHz is powerful enough for the current invention. With more advanced design, in which more than one instructions are performed for each clock cycle, a microprocessor running at a clock rate with a fraction of 115 MHz is powerful enough for the present application.

In FIG. 7*a* or 7*b*, the microprocessor 60 or the driver electronics 90 first compare the desired intensity I(i,j)—which is the desired light intensity in this case—with the set of intensity levels ($I_1$, $I_2$, $I_3$ . . . , and $I_K$) which have pre-calculated driving voltage stored in calibration memory 70, the microprocessor 60 or the driver electronics 90 find the two numbers (among $I_1$, $I_2$, $I_3$ . . . , and $I_K$) which are most close to the desired intensity I(i,j)); the microprocessor 60 or the driver electronics 90 will then fetch the driving voltages corresponding to these two numbers from calibration memory 70 and use liner approximation to calculate the driving voltage V(i,j) which can achieve the desired intensity I(i,j). In fact, one can also use polynomial approximation to calculate the driving voltage V(i,j) which can achieve the desired intensity I(i,j). For example, $$V(i,j) = \frac{(I_2 - I)(I_3 - I) \cdots (I_K - I)}{(I_2 - I_1)(I_3 - I_1) \cdots (I_K - I_1)} V_1(i,j) + \frac{(I_1 - I)(I_3 - I) \cdots (I_K - I)}{(I_1 - I_2)(I_3 - I_2) \cdots (I_K - I_2)} V_2(i,j) + \cdots$$

One can even use more complicated algorithm, such as, least square fit to calculate the driving voltage V(i,j) which can achieve the desired intensity I(i,j). Of course, the more complicated the algorithm, the more it is required for the processing power of the microprocessor 60 or the driver electronics 90. One need to make a compromise between the processing power and the amount of calibration memory required. With enough calibration memory, simple linear approximation algorithm can already provide the satisfactory results.

In present disclosed method, the process of compensating non-uniformity of a OLED display consists of the stage of measuring the display characteristics of every organic-light-emitting-element, the stage of determining the calibration parameters from the measured display characteristics, and the stage of using the calibration parameters of every organic-light-emitting-element to calculate the correct driving parameters which will give the desired luminosity levels.

For the stage of using the calibration parameters of every organic-light-emitting-element to calculate the correct driving parameters, one can use specially designed display processor to perform the calculation or use a software programmed general purpose microprocessor, which can even be the main CPU. As for the selecting of the calibration parameters, we listed several examples in the above presentation, such as, using the correct driving parameters for all gray levels of an organic-light-emitting-element as the calibration parameters, and using the correct driving parameters for selected gray levels of an organic-light-emitting-element as the calibration parameters. Based on above teaching, people skilled in the art can chose other kinds of parameters as the calibration parameters. In fact, without considering the requirement of the calibration memory or the processing power, one can simply chose the measured display characteristics of an organic-light-emitting-element directly as the calibration parameters, store that measured display characteristics directly into the calibration memory, and use the measured display characteristics from the calibration memory to calculate the correct driving parameters for that organic-light-emitting-element.

For any kinds of OLED displays based on matrix of organic-light-emitting-elements of any kinds, in any kind of driving arrangement. If any one of the individual organic-light-emitting-element in the matrix can be addressed independently, then, the display characteristics of any organic-light-emitting-element can be measured independently. Once the measured display characteristics of all organic-light-emitting-elements are measured, the correct driving parameters of all organic-light-emitting-elements can be calculated and stored as complete look-up tables, or the calibration parameters of all organic-light-emitting-elements can be calculated and stored as partial look-up tables in a calibration memory. A microprocessor can use the stored complete or partial look-up tables to obtain nearly perfect display uniformity based on the algorithm and methods disclosed in the present invention.

The forgoing description of selected embodiments and applications has been presented for purpose of illustration. It is not intended to be exhaustive or to limit the invention to the precise form described, and obviously many modifications and variations are possible in the light of the above teaching. The embodiments and applications described above was chosen in order to explain most clearly the principles of the invention and its practical application thereby to enable others in the art to utilize most effectively the invention in various embodiments and with various modifications as are suited to the particular use contemplated. Accordingly, the scope of the invention should be determined not by the embodiments illustrated, but by the appended claims and their legal equivalents.

I claim:

1. A method for creating a video data signal compensated for the non-uniformity of an OLED having a matrix of organic-light-emitting-elements, comprising the steps of:

measuring the emission curve of each organic-light-emitting-element in the matrix of organic-light-emitting-elements by measuring at least one data point on the emission curve;

deriving a set of fitting parameters including at least one member for the emission curve of each organic-light-emitting-element in the matrix of organic-light-emitting-elements from the measured data points on the emission curve of the corresponding organic-light-emitting-element;

storing into a calibration memory the set of fitting parameters for the emission curve of each organic-light-emitting-element in the matrix of organic-light-emitting-elements;

obtaining the compensated video word for each organic-light-emitting-element in the matrix of organic-light-emitting-elements by using the set of fitting parameters for the emission curve of the corresponding organic-light-emitting-element fetched from the calibration memory;

storing into a video memory having a matrix of memory-cells the compensated video word for each organic-light-emitting-element in the matrix of organic-light-emitting-elements; and creating the compensated video data signal by fetching the compensated video word for each organic-light-emitting-element from the video memory.

2. A method for creating a video data signal compensated for the non-uniformity of an OLED having a matrix of organic-light-emitting-elements, comprising the steps of:

measuring the emission curve of each organic-light-emitting-element in the matrix of organic-light-emitting-elements by measuring at least one data point on the emission curve;

deriving a set of fitting parameters including at least one member for the emission curve of each organic-light-emitting-element in the matrix of organic-light-emitting-elements from the measured data points on the emission curve of the corresponding organic-light-emitting-element;

storing into a calibration memory the set of fitting parameters for the emission curve of each organic-light-emitting-element in the matrix of organic-light-emitting-elements;

storing into a video memory having a matrix of memory-cells the uncompensated video word for each organic-light-emitting-element in the matrix of organic-light-emitting-elements;

obtaining the compensated video word for each organic-light-emitting-element in the matrix of organic-light-emitting-elements by using the set of fitting parameters for the emission curve of the corresponding organic-light-emitting-element fetched from the calibration memory; and creating the compensated video data signal by using the compensated video word generated from the step of obtaining.

3. A method of claim 1 or 2 wherein the video data signal is in the form of a series of digital word.

4. A method of claim 1 or 2 wherein the video data signal is in an analog wave form that uses the amplitude representing the luminosity of each pixel.

5. A method of claim 1 or 2 wherein said step of deriving further comprises the step of storing the measured data points of the emission curve of each organic-light-emitting-element first into a nonvolatile memory; and the step of loading the measured data points of the emission curve of each organic-light-emitting-element into a RAM from the nonvolatile memory.

6. A method of claim 1 or 2 wherein the calibration memory is a nonvolatile memory.

7. A method of claim 1 or 2 wherein the calibration memory is a volatile memory and said step of storing the set of fitting parameters further comprises the step of storing the set of fitting parameters for the emission curve of each organic-light-emitting-element first into a nonvolatile memory; and the step of loading the set of fitting parameters for the emission curve of each organic-light-emitting-element into the calibration memory from the nonvolatile memory.

8. A method of claim 1 or 2 wherein said step of deriving further comprises the step of determining the correct driving parameters for selected gray levels of the organic-light-emitting-element by using the measured data points on emission curve of the corresponding organic-light-emitting-element as the row data;

said step of storing into a calibration memory further comprises the step of storing the correct driving parameters for selected gray levels of the organic-light-emitting-element as a partial look-up table; and said step of obtaining further comprises the step of calculating the compensated video word by using the partial look-up table of the corresponding organic-light-emitting-element from the calibration memory as the raw data.

9. A method of claim 1 or 2 wherein said step of deriving further comprises the step of determining the set of fitting parameters for the emission curve of the organic-light-emitting-element based on a device model by using the measured data points on emission curve of the corresponding organic-light-emitting-element as the row data; and said step of obtaining further comprises the step of calculating the compensated video word by using the device model as the algorithm and by using the set of fitting parameters for the emission curve of the corresponding organic-light-emitting-element fetched from the calibration memory as the raw data.

10. A video interfacing electronics, for creating a video data signal compensated for the non-uniformity of an OLED having a matrix of organic-light-emitting-elements, having a video memory for storing the video pattern, comprising:

a calibration memory having a set of fitting parameters including at least one member for the emission curve stored therein for each organic-light-emitting-element in the matrix of organic-light-emitting-elements;

electronic circuitry for obtaining the compensated video word for each organic-light-emitting-element in the matrix of organic-light-emitting-elements by using the set of fitting parameters for the emission curve of the corresponding organic-light-emitting-element from said calibration memory;

electronic circuitry for storing into the video memory the compensated video word for each organic-light-emitting-element in the matrix of organic-light-emitting-elements; and electronic circuitry for creating the compensated video data signal by fetching the compensated video word for each organic-light-emitting-element from the video memory.

11. A video interfacing electronics, for creating a video data signal compensated for the non-uniformity of an OLED having a matrix of organic-light-emitting-elements, having a video memory for storing the video pattern, comprising:

a calibration memory having a set of fitting parameters including at least one member for the emission curve stored therein for each organic-light-emitting-element in the matrix of organic-light-emitting-elements;

electronic circuitry for storing into a video memory having a matrix of memory-cells the uncompensated video word for each organic-light-emitting-element in the matrix of organic-light-emitting-elements;

electronic circuitry for obtaining the compensated video word for each organic-light-emitting-element in the matrix of organic-light-emitting-elements by using the set of fitting parameters for the emission curve of the corresponding organic-light-emitting-element fetched from the calibration memory; and electronic circuitry for creating the compensated video data signal by using the compensated video word generated from the electronic circuitry for obtaining.

12. A video interfacing electronics of claim 10 or 11 wherein the calibration memory is a nonvolatile memory.

13. A video interfacing electronics of claim 10 or 11 wherein the calibration memory is a volatile memory, further comprising a nonvolatile memory having the set of fitting parameters for the emission curve of each organic-light-emitting-element stored thereinto; and electronic circuitry for loading the set of fitting parameters for the emission curve of each organic-light-emitting-element into said calibration memory from said nonvolatile memory.

14. A video interfacing electronics of claim 10 or 11 wherein said electronic circuitry for creating further comprising electronic circuitry for creating the video data signal in the form of a series of digital word.

15. A video interfacing electronics of claim 10 or 11 wherein said electronic circuitry for creating further comprising electronic circuitry for creating the video data in an analog wave form that uses the amplitude representing the luminosity of each pixel.

16. A video interfacing electronics of claim 10 or 11 wherein said calibration memory having the correct driving parameters for selected gray levels of each organic-light-emitting-element stored therein as the fitting parameters in the form of a partial look-up table; and said electronic circuitry for obtaining further comprises electronic circuitry for calculating the compensated video word by using the partial look-up table of the corresponding organic-light-emitting-element fetched from said calibration memory as the raw data.

17. A video interfacing electronics of claim 10 or 11 wherein the fitting parameter for the emission curve of said organic-light-emitting-element being the fitting parameters based on a device model for the emission curve of said organic-light-emitting-element, and said calibration memory having the fitting parameters stored therein; and said electronic circuitry for obtaining further comprises electronic circuitry for calculating the compensated video word by using the device model as the algorithm and by using the fitting parameters fetched from said calibration memory as the raw data.

18. A method for driving an OLED having a matrix of organic-light-emitting-elements driven by a plurality of column drive stages, comprising the steps of:

creating a video data signal compensated for the non-uniformity of the OLED;

converting the video data signal into corrected driving signals; and applying the corrected driving signals through the relative column drive stages.

19. The method of claim 18 for driving an OLED wherein the step of creating includes creating a video data signal with the method of claim 1.

20. The method of claim 18 for driving an OLED wherein the step of creating includes creating a video data signal with the method of claim 2.

21. The method of claim 18 for driving an OLED wherein the step of creating includes creating a video data signal with the video interfacing electronics of claim 10.

22. The method of claim 18 for driving an OLED wherein the step of creating includes creating a video data signal with the video interfacing electronics of claim 11.

* * * * *

US006473065C1

(12) EX PARTE REEXAMINATION CERTIFICATE (10067th)

United States Patent

Fan

(10) Number: US 6,473,065 C1

(45) Certificate Issued: *Mar. 4, 2014

(54) METHODS OF IMPROVING DISPLAY UNIFORMITY OF ORGANIC LIGHT EMITTING DISPLAYS BY CALIBRATING INDIVIDUAL PIXEL

(75) Inventor: Nongqiang Fan, Redmond, WA (US)

(73) Assignee: Canon Kabushiki Kaisha, Ohta-Ku, Tokyo (JP)

Reexamination Request:
No. 90/012,707, Oct. 22, 2012

Reexamination Certificate for:

| | |
|---|---|
| Patent No.: | **6,473,065** |
| Issued: | **Oct. 29, 2002** |
| Appl. No.: | **09/439,423** |
| Filed: | **Nov. 14, 1999** |

( * ) Notice: This patent is subject to a terminal disclaimer.

Related U.S. Application Data

(60) Provisional application No. 60/108,682, filed on Nov. 16, 1998.

(51) Int. Cl.
*G09G 3/32* (2006.01)

(52) U.S. Cl.
USPC .... 345/82; 315/169.1; 315/169.2; 315/169.3; 345/204; 345/205; 345/206; 345/60; 345/76; 345/77; 345/78; 345/83

(58) Field of Classification Search
None
See application file for complete search history.

(56) References Cited

To view the complete listing of prior art documents cited during the proceeding for Reexamination Control Number 90/012,707, please refer to the USPTO's public Patent Application Information Retrieval (PAIR) system under the Display References tab.

*Primary Examiner* — Joseph R. Pokrzywa

(57) ABSTRACT

Methods of improving the display uniformity of an OLED are disclosed. In order to improve the display uniformity of an OLED, the display characteristics of all organic-light-emitting-elements are measured, and calibration parameters for each organic-light-emitting-element are obtained from the measured display characteristics of the corresponding organic-light-emitting-element. The calibration parameters of each organic-light-emitting-element are stored in a calibration memory. One method for creating the compensated video data-signal is by storing into the video memory the compensated video word that is calculated based on the calibration parameters in the calibration memory and by fetching from the video memory the compensated video word. An alternative method for creating the compensated video data-signal is by fetching from the video memory the uncompensated video word and by using the calibration parameters in the calibration memory to calculate the compensated video data-signal.

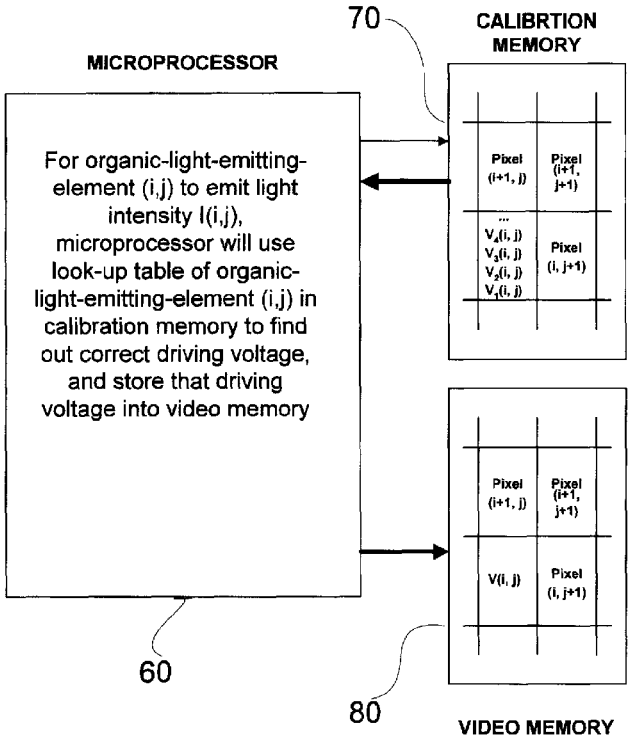

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 18 is determined to be patentable as amended.

New claims 23-25 are added and determined to be patentable.

Claims 1-17 and 19-22 were not reexamined.

18. A method for driving an OLED having a matrix of organic-light-emitting-elements driven by a plurality of column drive stages, comprising the steps of:

creating a video data signal compensated for the non-uniformity of the OLED *using one or more calibration parameters related to a light intensity to be displayed in a calibration memory*;

converting the video data signal into *a* corrected driving [signals] *signal*; and applying the corrected driving [signals] *signal* through the relative column drive stages,

*wherein the calibration parameters are loaded in the calibration memory from a nonvolatile memory, and*

*wherein the nonvolatile memory has a slower speed than the calibration memory and is capable of storing the calibration parameters recalculated to correct for a degrading of the organic-light-emitting-elements.*

*23. A method for driving an OLED having a matrix of organic-light-emitting elements driven by a plurality of column drive stages, comprising the steps of:*

*creating a video data signal compensated for the non-uniformity of the OLED by fetching two or more calibration parameters which are most close to a desired light intensity from a calibration memory and calculating the video data signal corresponding to the desired light intensity;*

*converting the video data signal into a corrected driving signal; and*

*applying the corrected driving signal through one of the relative column drive stages.*

*24. The method according to claim 23, wherein a step of fetching an uncompensated light intensity of a pixel from a video memory is conducted before the step of creating the video data signal.*

*25. The method according to claim 23, wherein a step of storing the compensated video data signal into a video memory is conducted between the step of creating the video data signal and the step of converting the video data signal.*

* * * * *